US011439922B2

(12) United States Patent
Monahan

(10) Patent No.: US 11,439,922 B2
(45) Date of Patent: Sep. 13, 2022

(54) BREAKABLE MULTI-COMPARTMENT STRUCTURE

(71) Applicant: Smakyata LLC, New Haven, CT (US)

(72) Inventor: Susan Monahan, New Haven, CT (US)

(73) Assignee: Smakyata LLC, New Haven, CT (US)

( * ) Notice: Subject to any disclaimer, the term of this patent is extended or adjusted under 35 U.S.C. 154(b) by 46 days.

(21) Appl. No.: 17/099,165

(22) Filed: Nov. 16, 2020

(65) Prior Publication Data

US 2021/0146271 A1 May 20, 2021

Related U.S. Application Data

(60) Provisional application No. 62/936,761, filed on Nov. 18, 2019.

(51) Int. Cl.
*A63H 37/00* (2006.01)
*B65B 5/06* (2006.01)

(52) U.S. Cl.
CPC ..... *A63H 37/00* (2013.01); *B65B 5/06* (2013.01)

(58) Field of Classification Search
CPC ..... A63H 37/00
See application file for complete search history.

(56) References Cited

U.S. PATENT DOCUMENTS

| | | | |
|---|---|---|---|
| 6,648,713 | B1 | 11/2003 | Oquita |
| 9,156,664 | B1 | 10/2015 | Lopez |
| 9,586,157 | B2 | 3/2017 | Garcia |
| 2003/0139276 | A1 | 7/2003 | Lozano |
| 2005/0197036 | A1 | 9/2005 | Won et al. |
| 2016/0129364 | A1 | 5/2016 | Ardura |
| 2018/0073675 | A1 | 3/2018 | Torres |

FOREIGN PATENT DOCUMENTS

| | | | |
|---|---|---|---|
| ES | 2328881 | A1 | 11/2009 |
| WO | 2002016002 | A1 | 2/2002 |
| WO | 2012158010 | A2 | 11/2012 |

OTHER PUBLICATIONS

Anderson, Make Your Own DIY Pinata for Cinco de Mayo, Worldmarket.com, Apr. 27, 2017, 10 pgs., https://www.worldmarket.com/blog/make-diy-pinata-cinco-de-mayo/.

Pinata Center, Custom Six Point Star Pinata, 2019, 4 pgs., http://www.pinatacenter.com/six-point-star-pinata.

*Primary Examiner* — John A Ricci
(74) *Attorney, Agent, or Firm* — Moyles IP, LLC

(57) ABSTRACT

A multi-compartment structure includes a central container that is independently fillable, sealable, and breakable from each of a plurality of fillable structures that are affixed to the central container. The multi-compartment structure is suspended from a suspension point by a suspension system including at least one supporting element and at least one suspending element. The multi-compartment structure may be used in a party game setting in which the multi-compartment structure is filled with novelty items, and a force is applied to the multi-compartment structure to break open each of the plurality of fillable compartments and the central container independently of one another to release the novelty items contained therein.

19 Claims, 12 Drawing Sheets

BREAKABLE MULTI-COMPARTMENT STRUCTURE

CROSS-REFERENCE TO RELATED APPLICATIONS

This application claims the benefit of U.S. Provisional Patent Application No. 62/936,761 filed Nov. 18, 2019, which is incorporated herein by reference in its entirety.

BACKGROUND OF THE DISCLOSURE

Breakable containers, known as pinatas, are commonly used as a source of entertainment at social gatherings. Traditionally, the breakable container is filled with items, such as toys, candy, or other novelty products (collectively "novelty items"), and suspended in the air. Participants take turns hitting the container with a stick, and the game ends when the compartment is broken open to release the items held inside. The participant that breaks open the container may be considered the winner of the game.

Although these breakable containers are made in a variety of shapes and sizes, they typically include only a unitary, undivided compartment for filling, sealing, and breaking open. Thus, a user of the container does not have the option to separately fill and seal independent compartments of the container with unique items, nor is a user is able to break open the individual compartments of the container to prolong the game and allow for more participation. As a result, entertainment from the typical breakable container ends when the single compartment is broken open and the contents are released.

The breakable container is typically suspended from a stable structure at an elevated height, such as a beam or a tree branch, to allow participants to swing at the container with a stick or bat. Typical breakable containers are suspended from a single point or along a single axis of the structure. This can result in the container breaking prematurely due to the container material tearing at the suspension point.

Accordingly, there is a need for a breakable container that includes multiple compartments for independent filling, sealing and breaking. There is also a need for a suspension system which supports the weight of the breakable container from its base to alleviate tension from a single suspension point.

BRIEF DESCRIPTION

This disclosure generally describes a multi-compartment structure for storing a variety of novelty items to be released in a party game setting. The multi-compartment structure includes a central container including a plurality of walls defining a fillable central interior, with one wall being an at least partially openable wall. A fillable compartment is at least partially affixed to each of the walls of the central container, the fillable compartment including a fillable compartment interior. A suspension system including at least one supporting element and a suspending element are joined to one another to suspend the multi-compartment structure from a suspension point. The supporting element extends across the external surface of at least one of the central container walls to traverse a bottommost point of the central container.

In an aspect, the exemplary embodiments include a multi-compartment structure for storing a variety of novelty items to be released in a party game setting, including a central container having a plurality of walls including a partially openable wall, the plurality of walls defining a fillable central interior, and a plurality of fillable compartments at least partially affixed to each of the walls, each of the fillable compartments including a fillable compartment interior, and a suspension system including at least one supporting element extending across the external surface of more than one of the walls to traverse a bottommost point of the central container, and a suspending element configured for suspending the multi-compartment structure from a suspension point, where the supporting element and suspending element are joined to one another inside the fillable central interior of the central container.

In another aspect, the exemplary embodiments include a multi-compartment structure for use as a party game, the multi-compartment structure including a central container having a plurality of exterior walls, and a plurality of fillable compartments joined to the central container, where the central container and the plurality of fillable compartments are each independently configured for receiving novelty items, such that the walls of the central container separate the novelty items in the central container from the novelty items in the plurality of fillable compartments, and wherein the party game includes imparting a force to the multi-compartment structure to at least partially separate each of the plurality of fillable compartments from the central container and release the novelty items contained therein.

In another aspect, the exemplary embodiments include a method of assembling a multi-compartment structure including the steps of forming a central container having a plurality of walls, the plurality of walls including a partially openable wall, forming a fillable compartment, affixing a base edge of the fillable compartment to an exterior surface of a wall of the central container, positioning at least one supporting element around the central container to traverse a bottommost point of the central container, filling the multi-compartment structure, and sealing the multi-compartment structure.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
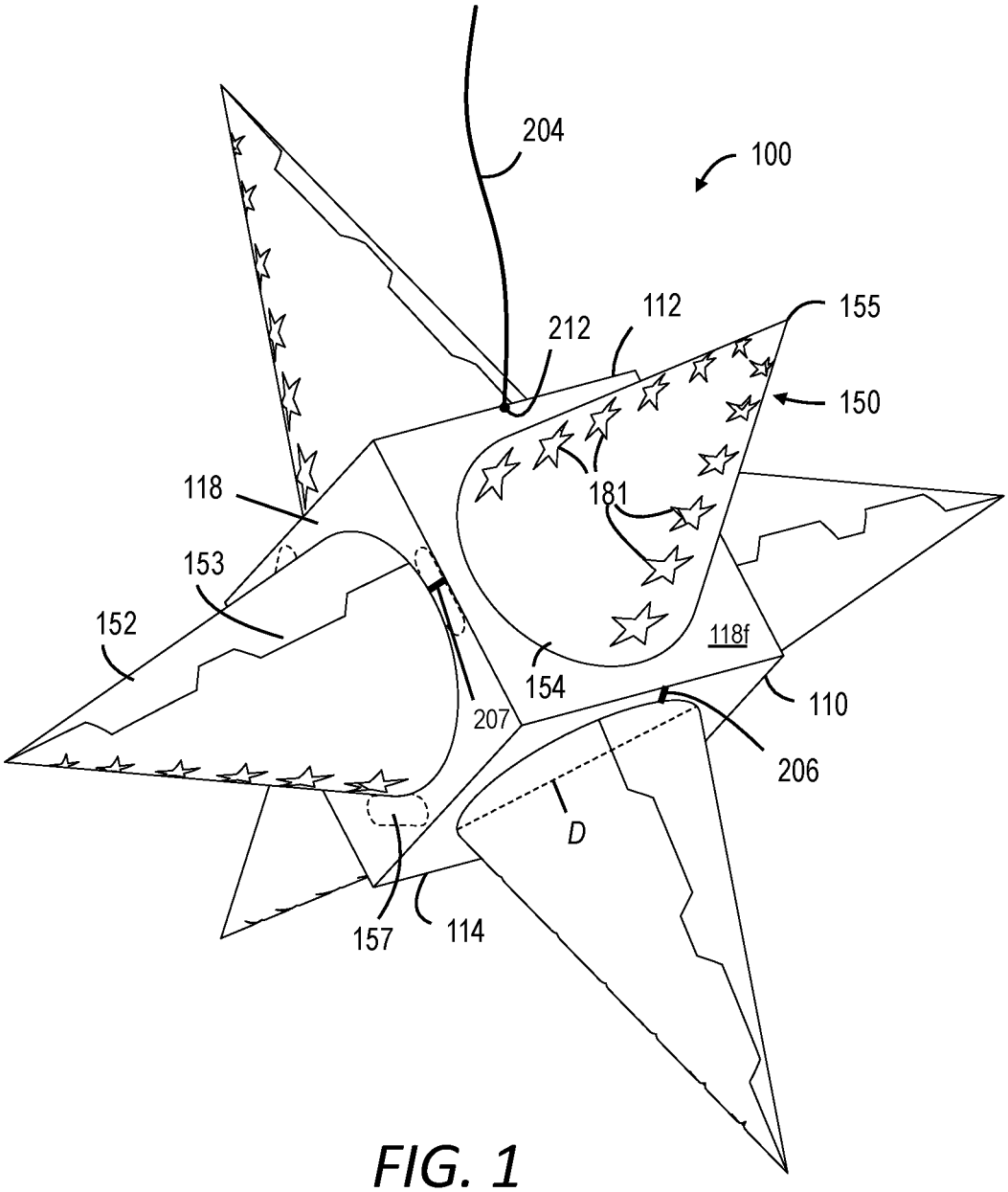
FIG. 1 is a side perspective view of a multi-compartment structure according to an embodiment, including a central container and a plurality of fillable compartments.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

Embodiments described herein relate generally to devices and methods for a multi-compartment structure. For purposes of this disclosure, the phrases "devices" and "methods" may be used either individually or in any combination referring without limitation to disclosed components, grouping, arrangements, steps, functions, or processes.

For purposes of illustrating features of the embodiments, an exemplary embodiment will now be introduced and referenced throughout the disclosure. This example is illustrative and not limiting and is provided for illustrating the exemplary features of a multi-compartment structure as described throughout this disclosure.

Figure 8:
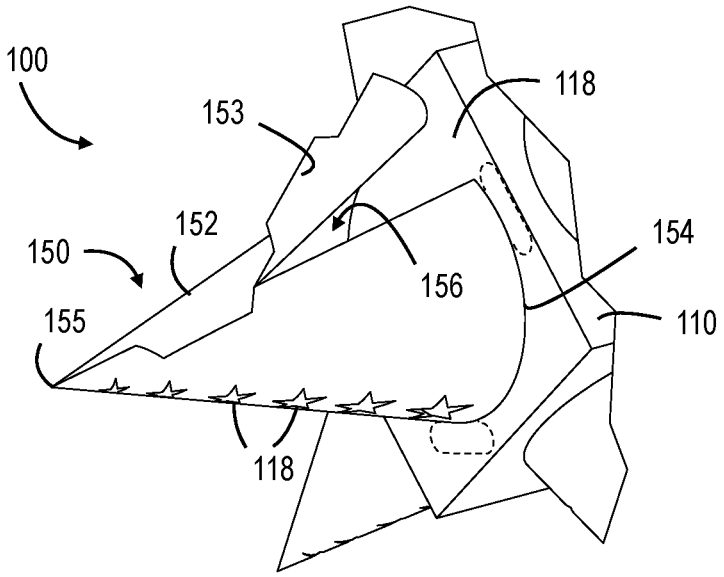
FIG. 8 is a partial cutaway perspective view of the multi-compartment structure of FIG. 1, showing a releasable flap of the fillable structure in an open position.

Turning now to FIG. 1, an embodiment of the multi-compartment structure 100 is shown. The multi-compartment structure 100 may be used in a party game setting to store a variety of novelty items that are held within the multiple compartments of the structure until participants break the compartments open to release the novelty items. The multi-compartment structure 100 generally includes a central container 110 having a plurality of walls (118*a*-118*f*, generally 118). The plurality of walls 118 extend around and/or at least partially define a fillable central interior 116 (FIG. 3) of the central container 110. A plurality of fillable compartments 150 (in this example, six fillable compartments 150) may extend from the external surfaces of the walls 118. Each fillable compartment 150 includes a fillable compartment interior 156 (FIG. 8). The fillable compartments 150 may be of any shape or size to allow for attachment to the central container 110, and the dimensions of the plurality of fillable compartments 150 may be identical or may vary between the fillable compartments 150. The central container 110 and the plurality of fillable compartments 150 are each independently openable, fillable, and sealable, which extends the duration of the game and allows more than one user to be successful in the breaking open of the multiple independent compartments. With reference to FIG. 1, a multi-compartment structure 100 having one central container 110 and six independently fillable and sealable compartments 150 hypothetically affords up to seven users the opportunity to successfully break open one of the six compartments 150 or the central container 110. The central container 110 and compartments 150 can each independently be filled with different prizes that are kept separate from one another. For example, a high value prize can be stored in the central container 110 and low value prizes can be stored in the plurality of fillable compartments 150. When in use, the multi-compartment structure 100 is suspended from a suspension element 204 that connects to supporting elements 206, 207 of a suspension system 200, as discussed in further detail below in connection with FIGS. 12-14.

The central container 110 may have any desired number of walls 118 and may be formed in any shape or size desired. For example, the central container 110 may be in the shape of a polyhedron, a word or phrase, an animal, or a cartoon character. In the illustrated example, the central container 110 is shaped substantially as a cube with six substantially square walls 118. However, numerous other possibilities are contemplated. According to an aspect, the central container 110 may be formed from a single sheet of material or from a blank assembled from multiple sheets of material.

Figure 2:
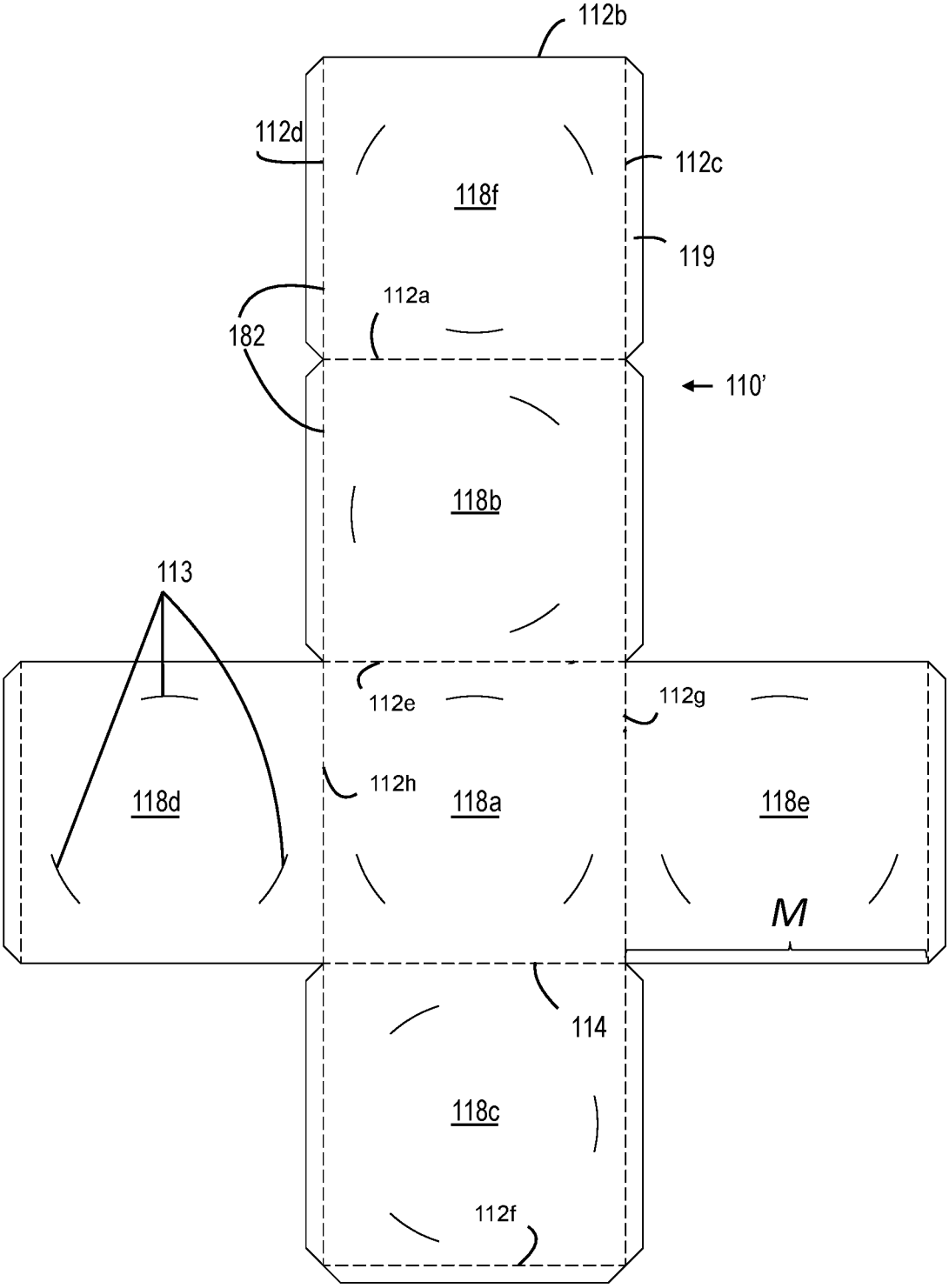
FIG. 2 is a top plan view of a blank used to form the central container of the multi-compartment structure of FIG. 1.

As illustrated in FIG. 2, the central container 110 may be formed from a blank 110' cut from a single sheet of material including a plurality of walls/wall panels 118*a*, 118*b*, 118*c*, 118*d*, 118*e*, 118*f* joined to one another along score lines 112*a*-112*h*, 114 (or other lines of disruption, such as cuts, perforation lines, or the like). The blank 110' further includes a plurality of sealing elements 119 (e.g., panels/flaps, etc.) (only one of which is labeled) extending along some edges of some of the wall panels along score lines 182 (or other lines of disruption) (only two of which are labeled). In this example, the sealing elements 119 extend along some edges of wall panels 118*c*, 118*d*, 118*e*, 118*f*, but other configurations are possible. The sealing elements 119 may include an adhesive with a releasable strip (not shown), or may be for receiving glue or other sealing material. Wall panels 118*a*, 118*b*, 118*c*, 118*d*, 118*e*, 118*f* each include a plurality of cuts/slots 113 (only some of which are labeled) for receiving attachment elements 157 (FIG. 1) of the fillable compartments 150, as will be discussed below.

Figure 3:
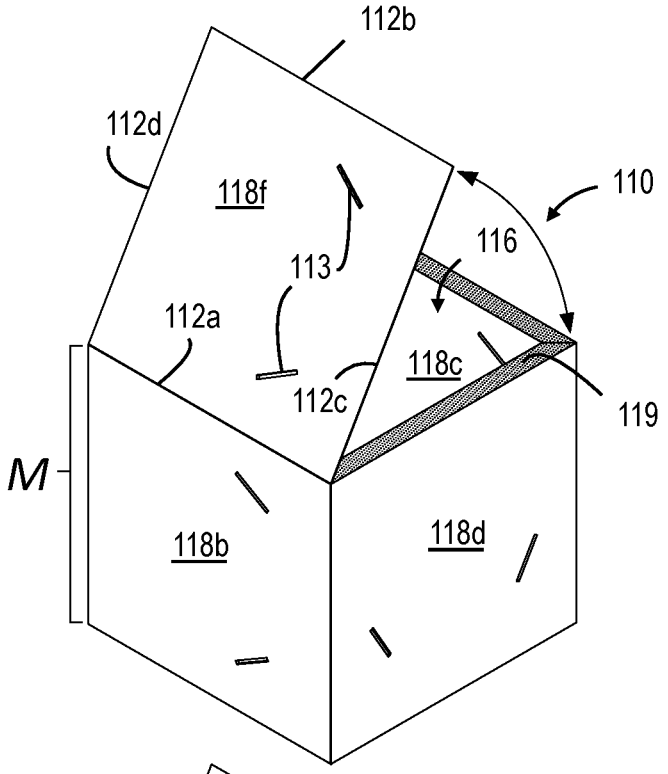
FIG. 3 is a rear perspective view of a central container for use with the multi-compartment structure of FIG. 1, in a partially assembled configuration.

The various wall panels 118*a*, 118*b*, 118*c*, 118*d*, 118*e*, 118*f* may be folded into a cube shape along their respective score lines 112 and joined to one another using sealing elements 119 (e.g., folded along score lines 182 and joined using a glue or adhesive) to assemble the central compartment 110 (FIG. 1), as shown in FIG. 3. The score lines 112 define edges (e.g., edges 112, 114) of the walls 118 of the central container 110. According to an aspect, the plurality of walls 118 of the central compartment 110 may include a first wall 118*a* opposite the partially openable wall 118*f*, a second wall 118*b* adjacent each of the first wall 118*a* and the sixth wall/partially openable wall 118*f*, a third wall 118*c* adjacent the first wall 118*a*, a fourth wall 118*d* adjacent each of the first wall 118*a*, second wall 118*b*, and third wall 118*c*, and a fifth wall 118*e* (hidden from view) opposite the fourth wall 118*d*. In an embodiment of the multi-compartment structure 100, the walls are squares and each wall 118 has a side measurement M of 9.5 inches. However, other dimensions for the various walls may be used.

As shown in FIG. 3, the sixth wall 118*f* may be at least partially openable to provide access to the fillable central interior 116 for filling, and closable for sealing the central container 110 with sealing elements 119 to prevent contents of the central container 110 from exiting the central container 110, either by falling out of the central container 110 or commingling with contents of the plurality of fillable compartments 150. In the illustrated example, wall 118*f* is connected by hinged edge 112*a* to wall 118*b* for opening and closing the wall 118*f*. In an aspect, wall 118*f* is partially openable and may be configured to hingedly open to provide access to the fillable central interior 116 of the central container 110. Open edges 112*b* (opposite edge 112*a*) and 112*c* and 112*d* (adjacent edge 112*a*) are provided for opening and sealing of the central container 110 by the user.

Figure 4:
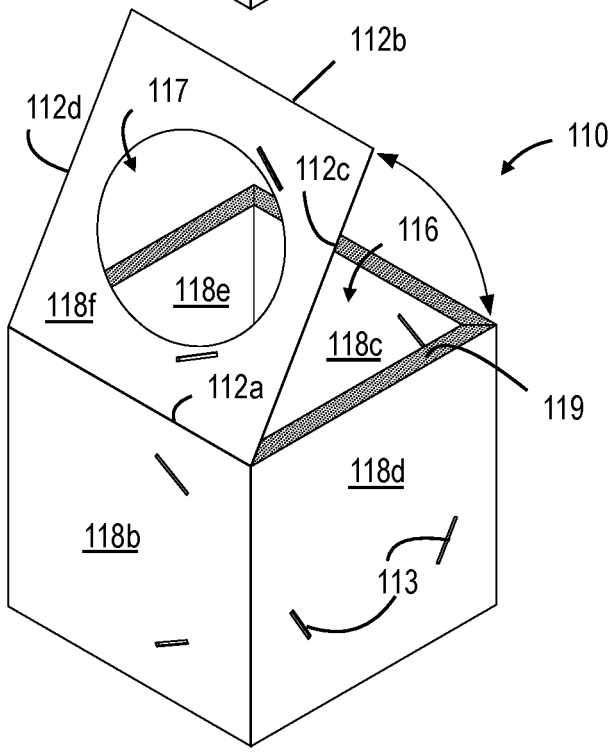
FIG. 4 is a rear perspective view of a central container for use with the multi-compartment structure of FIG. 1, in a partially assembled configuration.

In an alternate embodiment shown in FIG. 4, the partially openable wall 118*f* may also provide access to the fillable central interior 116 via a hole 117 (i.e., an opening) formed in the partially openable wall 118*f*. The hole 117 may be sealed by securing onto the partially openable wall 118*f* a fillable compartment 150 including a base panel 120 sized and shaped to cover the hole 117 (see the example shown in FIG. 14B). Alternatively, the hole 117 may be covered by other means, such as a separate attachable cover, piece, panel, sticker, or otherwise. In another embodiment (not shown), wall 118*f* may not be partially openable, but may include hole 117 for accessing the inside of the fillable compartment 150. In yet another embodiment (not shown), wall 118*f* may be completely openable (i.e., removable and re-attachable) to provide access to the interior 116 of the central container 110.

Returning to FIG. 1, each fillable compartment 150 is substantially cone-shaped, and includes a base edge 154, a tip 155, and a face panel 152 extending between the base edge 154 and the tip 155. The fillable compartment 150 has an overall cone shape, such that its cross-sectional diameter D increases from the tip 155 to the base edge 154. However, other shapes for the compartments 150 are contemplated.

Figure 5:
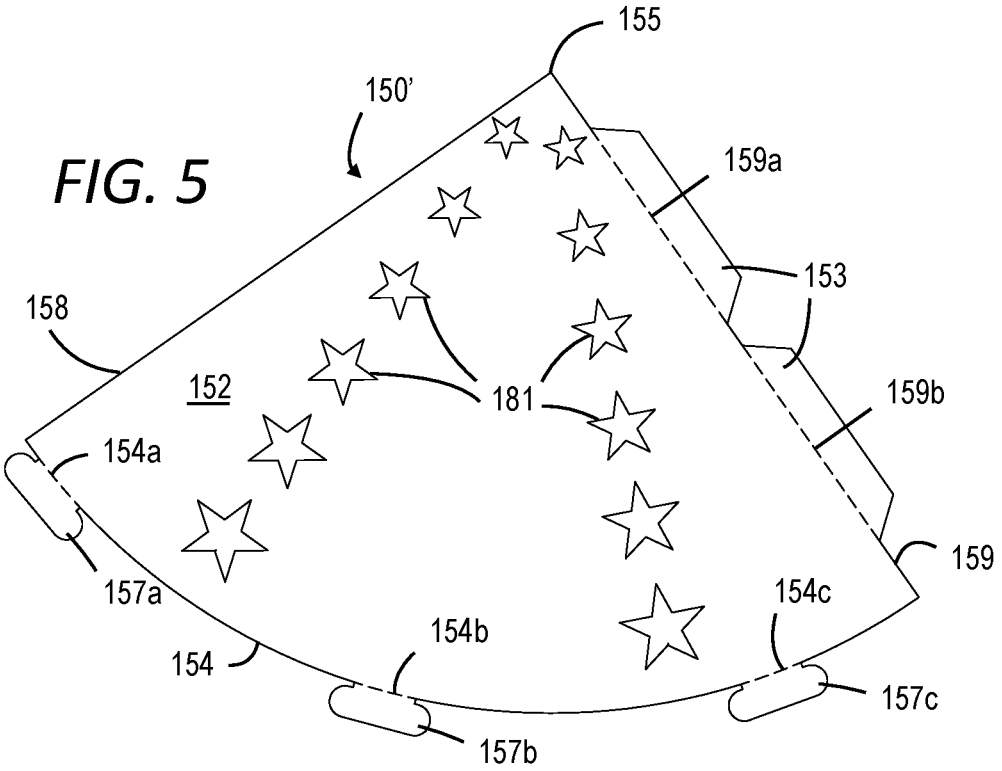
FIG. 5 is a top plan view of a blank used to form a fillable structure of the multi-compartment structure of FIG. 1.

In some exemplary embodiments, each fillable compartment 150 may be formed from a single piece of material, as shown in FIG. 5, which depicts one of the fillable compartments 150 in an unassembled configuration as a blank 150'. The fillable compartment blank 150' generally includes the face panel 152 (FIG. 1), which has a substantially quarter-circle shape bounded by two substantially linear side edges 158, 159 and a curved (e.g., arc-shaped) base edge 154. The blank 150' also includes an attachment element 157 (attachment elements 157*a*, 157*b*, 157*c*, e.g., tabs) extending from/joined to the face panel 152 along score lines 154*a*, 154*b*, 154*c* (or other lines of disruption, as discussed above) for connecting the assembled compartment 150 to the central container 110. The blank 150' further includes a plurality of releasable (and resealable) side flaps 153 joined to the face panel 152 along score lines 159*a*, 159*b* (or other lines of disruption, as discussed above). The various score lines 154*a*, 154*b*, 154*c*, 159*a*, 159*b* facilitate the assembly and attachment of the fillable compartment 150 to the central container 110.

To form the blank 150' into the compartment 150, edge 158 may be brought towards edge 159 (or vice versa), and flaps 153 may be folded along score lines 159*a*, 159*b* and joined to a surface (in this example, an exterior surface) of the face panel 152 (using glue or otherwise). In this assembled configuration (FIG. 1), the base edge 154 defines the base of the compartment, and the intersection of the linear side edges 158, 159 defines the tip 155 of the compartment 150.

Figure 6:
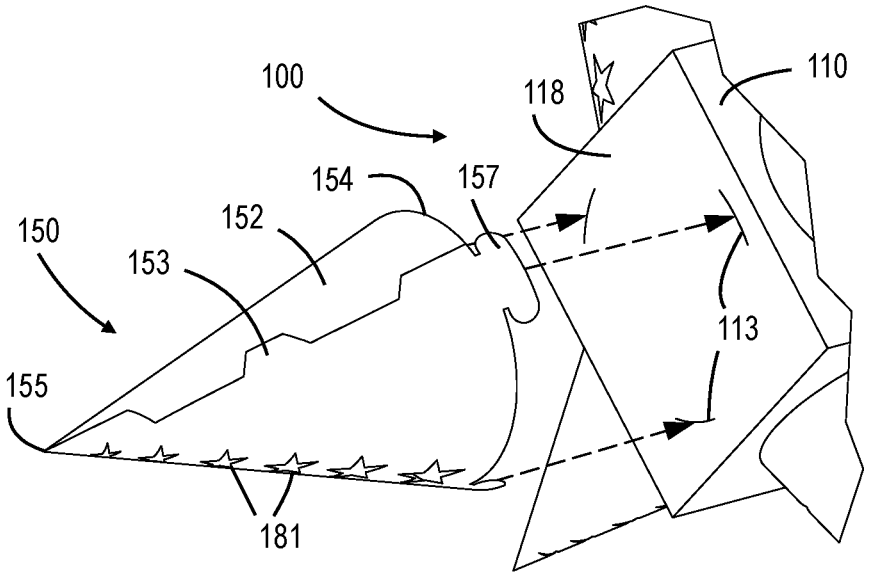
FIG. 6 is an exploded, partial cutaway perspective view of the multi-compartment structure of FIG. 1, showing attachment of one of the assembled fillable compartments to a wall of the central container.
Figure 7:
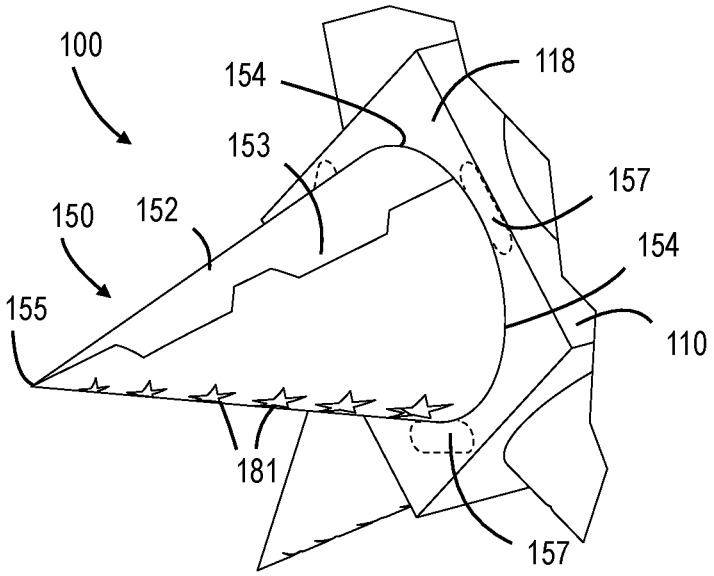
FIG. 7 is a partial cutaway perspective view of the multi-compartment structure of FIG. 1, showing the assembled fillable structure attached to the wall of the central container.

As shown in FIGS. 6 and 7, each fillable compartment 150 may be joined to a wall 118 of the central container 110 by inserting tabs 157 into slots 113 within the respective wall 118. The tabs 157 may be bent towards the respective wall 118 to assist with securing the compartment 150 to the container 110. If desired, the tabs 157 may include an adhesive for further securing the compartment 150 to the central container 110.

As shown in FIG. 8, at least one of the side flaps 153 may be released and resealed as needed to provide access to the fillable compartment interior 156 of the fillable compartment 150 after securement to the central container 110. The releasable side flap 153 may include any means for securing the releasable side flap 153 to the face 152 of the fillable compartment 150, such as an adhesive. In an alternate embodiment (not shown), the side flaps 153 may be replaced with tabs that can be inserted into a corresponding slot (not shown) on the face 152 of the fillable compartment 150.

Figure 9A:
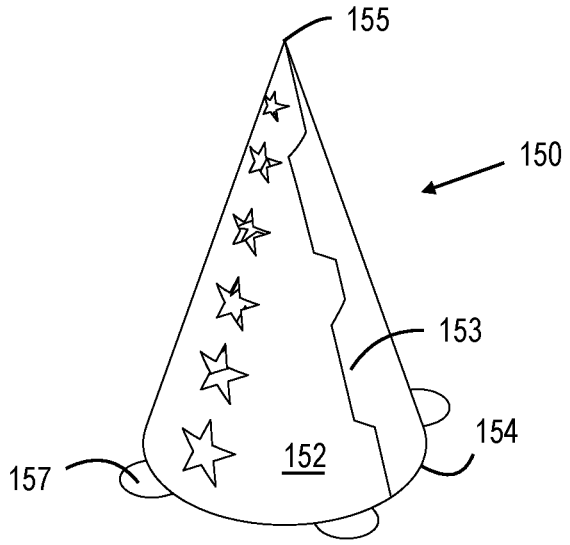
FIG. 9A is an alternate fillable structure for use with the multi-compartment structure of FIG. 1, in an assembled configuration.
Figure 9B:
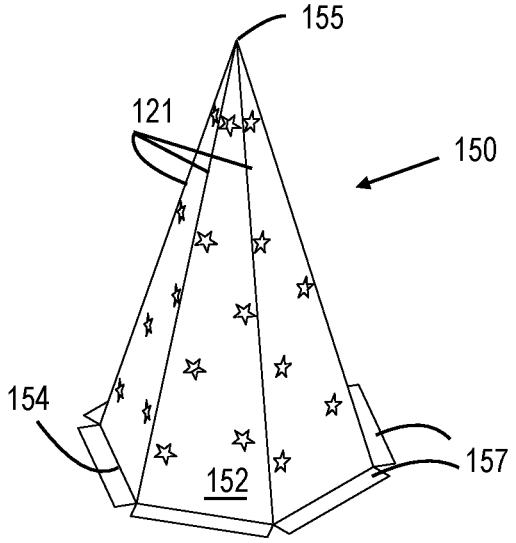
FIG. 9B is a further alternate fillable structure for use with the multi-compartment structure of FIG. 1, in an assembled configuration.

FIGS. 9A and 9B illustrate alternate embodiments of the fillable compartments 150 having a different attachment element 157 shape. The attachment elements 157 shown in FIGS. 9A and 9C have a semi-circular shape, while the attachment elements 157 shown in FIG. 9B have a rectangular shape. The attachment element may be a tab that is received in a corresponding slot, and/or may include an adhesive to be joined to an interior surface or exterior surface of the central container 110. In other embodiments (not shown), the attachment elements may be any other suitable shape, for example, trapezoidal or triangular. The attachment elements 157 contemplated with reference to these figures may be incorporated in embodiments of the fillable compartments 150 having different design features. Additionally, in the embodiments shown in FIGS. 9B and 9C, the face panel 152 of the fillable compartments 150 may be scored to create a hexagonal cone shape with a plurality of planar sections 121 forming the face 152.

Other variations are contemplated. For example, with reference to FIG. 10, which illustrates another embodiment of a multi-compartment structure 300, the base edge 154 of the fillable compartment 150 may be partially affixed to the central container 110 by less than all of the attachment elements 157 (e.g., elements 157*a*, 157*b*, 157*c*, and so on), and then sealed to the central container 110 by the final attachment element 157 once the fillable compartment 150 is filled with the desired items. In an embodiment, a first attachment element 157*a* secures a portion of the base edge 154 to the external surface of the wall 118 and attachment elements 157*b*, 157*c* secure the remainder of the base edge 154 via insertion of tabs into slots 113 formed on the wall 118, or vice versa. Alternatively or additionally, one or more of the fillable compartments 150 may have a releasable/resealable portion (such as the releasable side flap discussed above) to allow for filling.

The central container 110 and fillable compartments 150 may be formed of a frangible or breakable material that is not fragile, for example, paperboard, cardboard, fiber board, butter board, or any other suitable material. Any of such materials may be formed from virgin or recycled fibers. In some instances, the thickness of the material may be from about 0.8 mm to about 4.8 mm. A user of the multi-compartment structure 100 may select the composition and thickness of the material use for construction of the structure 100 depending on the desired level of difficulty to break open the compartments. For example, if the structure 100 is intended to be used by young children, the material may be less thick to ensure that the compartments will be broken open by the users. If the structure 100 is intended to be used by adults, a thicker material can be used to prolong the length of the game.

Figure 9C:
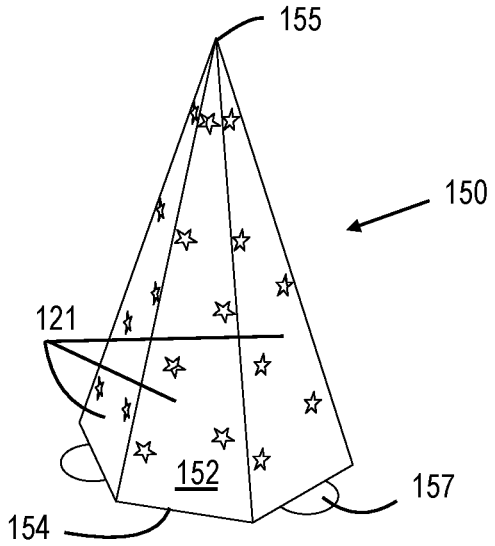
FIG. 9C is a further alternate fillable structure for use with the multi-compartment structure of FIG. 1, in an assembled configuration.

The material composition and/or thickness may vary through the multi-compartment structure 100 to provide, for example, a plurality of fillable compartments 150 that are less difficult to break open relative to the central container 110. Depending on user preference, the material forming one or all of the central container 110 and fillable compartment 150 may be more or less resilient to breaking. For example, the central container 110 and/or the fillable compartment 150 may include an aperture 181 (see, e.g., FIGS. 1, 9A, 9B, 9C) extending therethrough to reduce resiliency of the structure 100 and allow for the structure 100 to break more easily. The aperture 181 may be customized with respect to size, shape, and quantity. According to an aspect, apertures 181 may be positioned randomly on the fillable compartment 150, as shown in FIGS. 9A-9C, or the apertures 181 may be organized in one or more rows between the tip 155 and the base edge 154. In the embodiment shown in FIG. 1, two rows of apertures 181 are spaced equidistantly from the releasable side flap 153 about the face 152 of the fillable compartment 150. According to an aspect, the apertures 181 may have a diameter of from about 1.0 to about 1.5 inches. As another example, the central container 110 and/or the fillable structures may include surface perforations 183 to reduce resiliency of the structure 100 and increase breakability of the compartments, as shown with the embodiment of a multi-compartment structure 400 of FIG. 11. According to an aspect, the surface perforations 183 may extend from the tip 155 of the fillable compartment 150 to the base edge 154, and may be formed on one or more of the planar sections 121 forming the face 152 of the fillable compartment 150. According to an aspect, the surface perforations 183 are no larger than about 5 mm in size, and are positioned randomly on the structure 100. In an embodiment (not shown), the surface perforations 183 are formed in the fillable compartment 150 as horizontal rings extending from the base edge 154 to the tip 155. According to an aspect, the multi-compartment structure 100 may include both apertures 181 and surface perforations 183.

Numerous variations of the multi-compartment structures 100 discussed above are contemplated hereby. The exterior surfaces of the central container 110 and fillable compartments 150 may be decorated as desired to reflect the theme of an event at which the multi-compartment structure 100 is used. Surface decorations may include words, images, colors, or designs reflective of the event theme. The external decorations may be selected to coordinate with the contents of the central container 110 and the fillable compartments 150.

With reference to FIGS. 12A-14B in particular, the central container 110 of the multi-compartment structure 100 is suspended in the air during use by a suspension system 200. The suspension system may have various configurations, but may generally include a suspending element 204, a first supporting element 206, and a second supporting element 207.

Figure 12A:
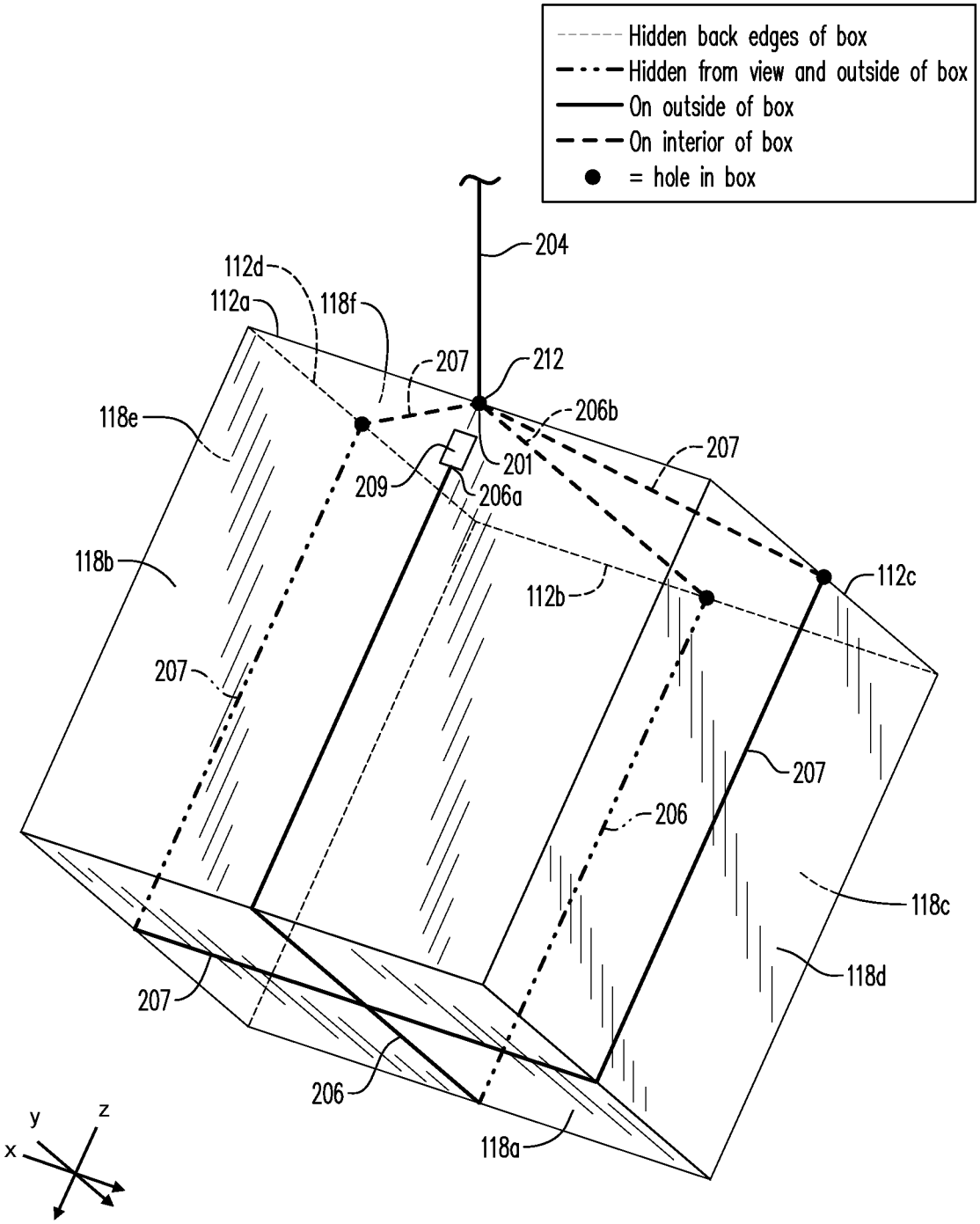
FIG. 12A is a rear perspective view of the central container of the multi-compartment structure of FIG. 1, showing the multi-compartment structure suspension system according to an embodiment.
Figure 12B:
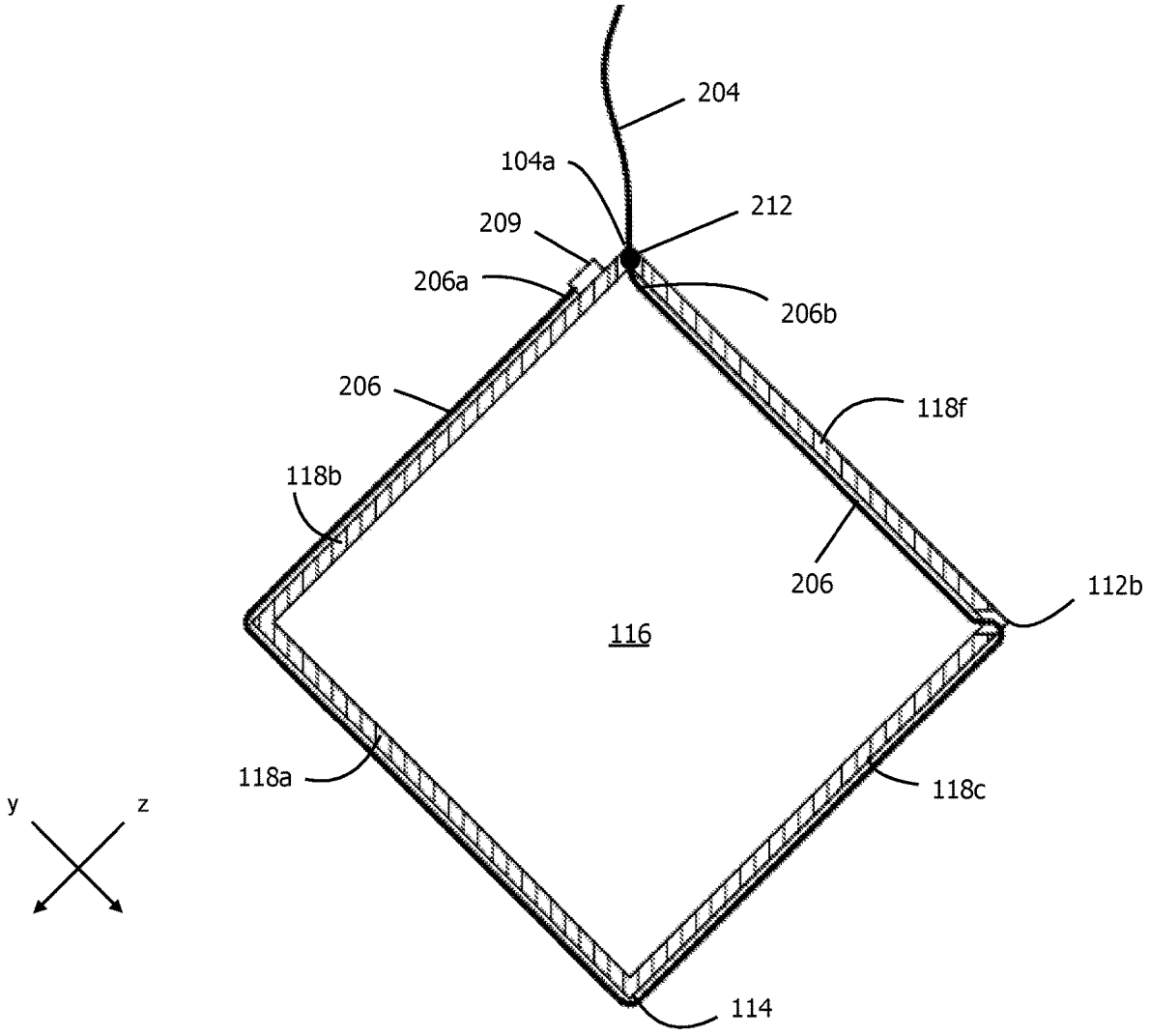
FIG. 12B is a cross-sectional side view of the central container of FIG. 12A, showing a portion of the suspension system according to an embodiment.

FIGS. 12A and 12B illustrate one exemplary suspension system, in which the suspending element 204 extends from an edge 112*a* of the central container 110 (e.g., as shown in FIG. 1). In this exemplary system, the first and second supporting elements 206, 207 (e.g., strings, cords, wires, or the like) extend generally across the interior and/or exterior of the various walls 118*a*-118*f* and are connected to the suspending element 204 at a connection point 201 (e.g., a knot, fastener, or other means of attachment). According to an aspect, the connection point 201 may be located within the interior of the central container 110.

Now describing the system 200 in greater detail, as seen in FIG. 12A, the first supporting element 206 extends across or traverses the external surfaces of walls 118*b*, 118*a*, and 118*c* and the edges connecting the walls, including a bottommost edge 114 connecting wall 118*a* and wall 118*c*. In an embodiment and as shown in a fully assembled structure 100 in FIG. 1, the bottommost point of the central container 110 is the edge 114 opposite to the edge 112*a* (adjoining walls 118*f* and 118*b*) along which a suspension exit point 212 is formed. As best seen in FIG. 12B (which illustrates an exemplary cross-sectional view of the central container 110 of FIG. 12A), a first end 206*a* of the first supporting element 206 may be secured to the external surface of wall 118*b*, for example with an adhesive 209. The supporting element 206 may extend along an x-z plane coaxially with a line defining the midpoint of each wall 118*b*, 118*c* and along an x-y plane coaxially with a line defining the midpoint of wall 118*a*. A second end 206*b* of the first supporting element 206 may extend into the interior of the central container 110 by passage along edge 112*b* (e.g., when the at least partially openable wall 118*f* is open) to terminate internally of the central container 110 at connection point 201, as shown in FIG. 12B. The connection point 201 defines the point at which one or more ends of the supporting elements 206, 207 (shown in FIG. 12A) connect to the suspending element 204. According to an aspect, the connection point 201 may be located internally of the central container 110 adjacent the suspension exit point 212. Suspending element 204 may pass through the suspension exit point 212 of the central container for connection to a suspension point in the external environment (not shown).

Returning to FIG. 12A, the second supporting element 207 may likewise extend across various walls 118 on a single y-z plane that is perpendicular to the first supporting element 206. The second supporting element 207 may extend coaxially along a line defining the midpoint of at least one wall 118 (referred to generally), and in this example, the second supporting element 207 extends across walls 118*d*, 118*a*, and 118*e*. The first supporting element 206 and second supporting element 207 cross or intersect perpendicularly at a center point on a bottom wall 118*a*, though it should be noted that in other embodiments, the supporting elements 206, 207 may be positioned relative to one another in any other configuration that provides a cradling support to the central container 110. Similar to supporting element 206, the ends of supporting element 207 may pass under the partially openable wall 118*f* to connect at the connection point 201 with supporting element 206 and suspending element 204. The ends of the suspending element 207 may extend at a 45-degree angle to meet at the connection point 201 after passing under the partially openable wall 118*f* into the interior of the central container 110.

Figure 10:
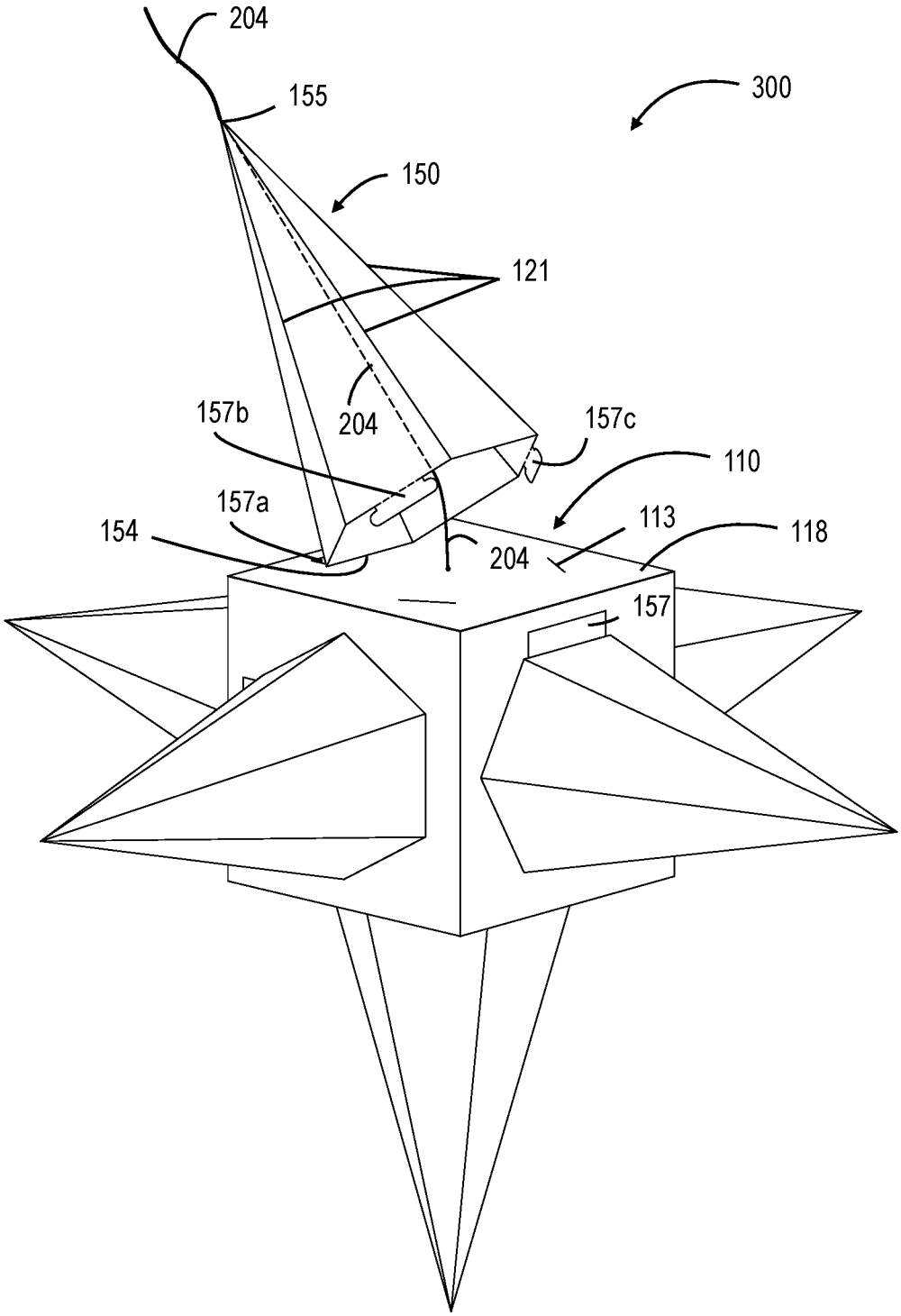
FIG. 10 is a side perspective view of yet another multi-compartment structure according to an embodiment, showing a suspension system extending from the central container through one of the plurality of fillable structures that is partially attached to a wall of the central container.
Figure 11:
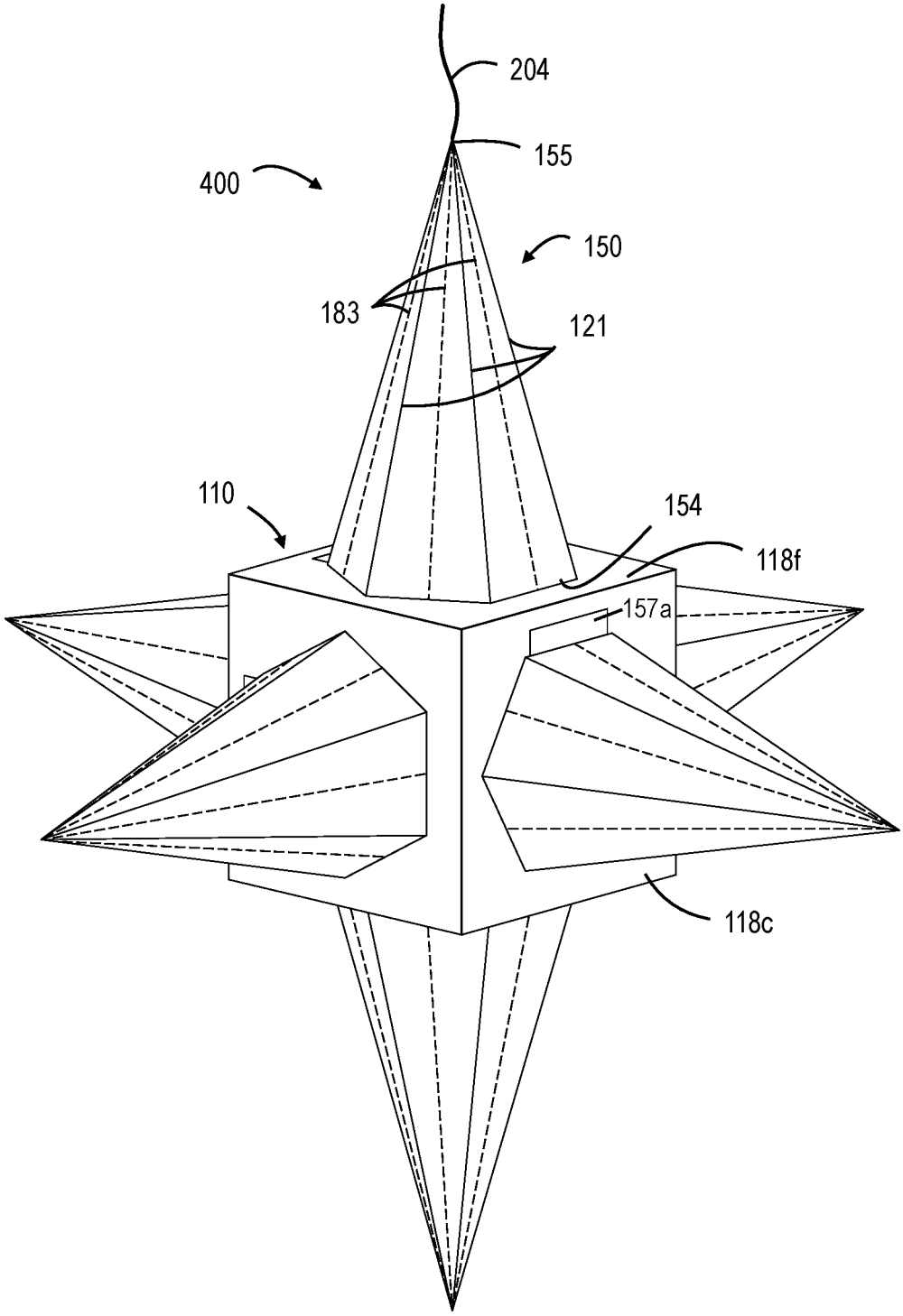
FIG. 11 is a side perspective view of another multi-compartment structure according to an embodiment, including a central container and a plurality of alternate fillable structures having surface perforations.
Figure 13A:
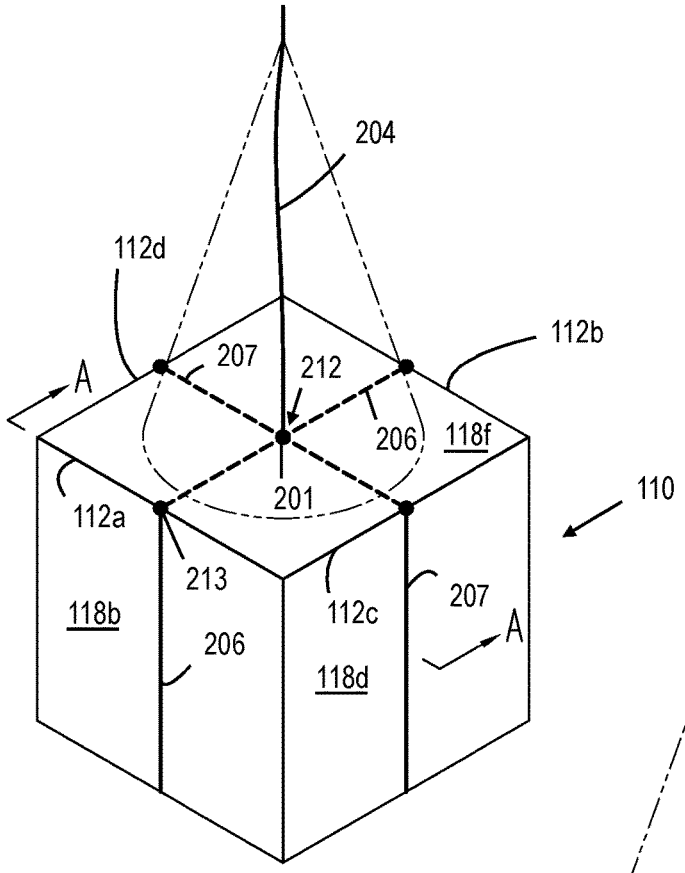
FIG. 13A is a partial cutaway perspective view of the central container and suspension system of the multi-compartment structure according to FIGS. 10-11.
Figure 13B:
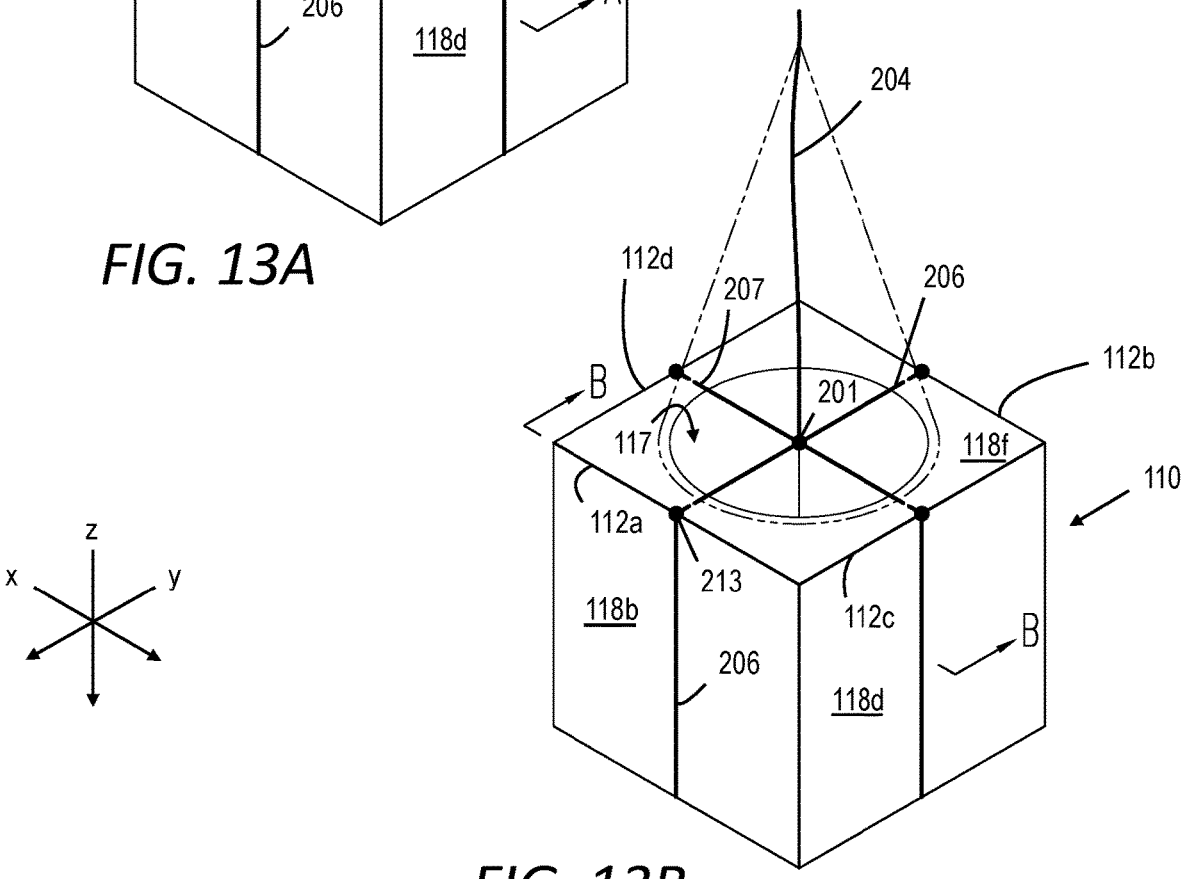
FIG. 13B is a perspective partial cutaway view of an alternate central container and suspension system of the multi-compartment structure according to an embodiment.
Figure 14A:
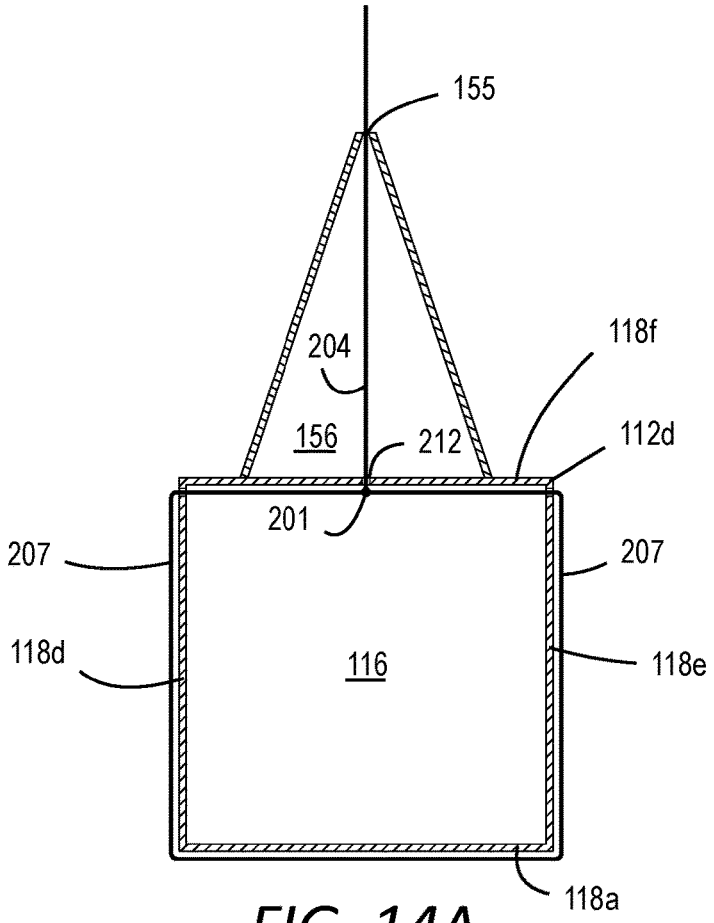
FIG. 14A is a cross-sectional front view of the central container and suspension system of the multi-compartment structure of FIG. 13A, taken along line A-A.
Figure 14B:
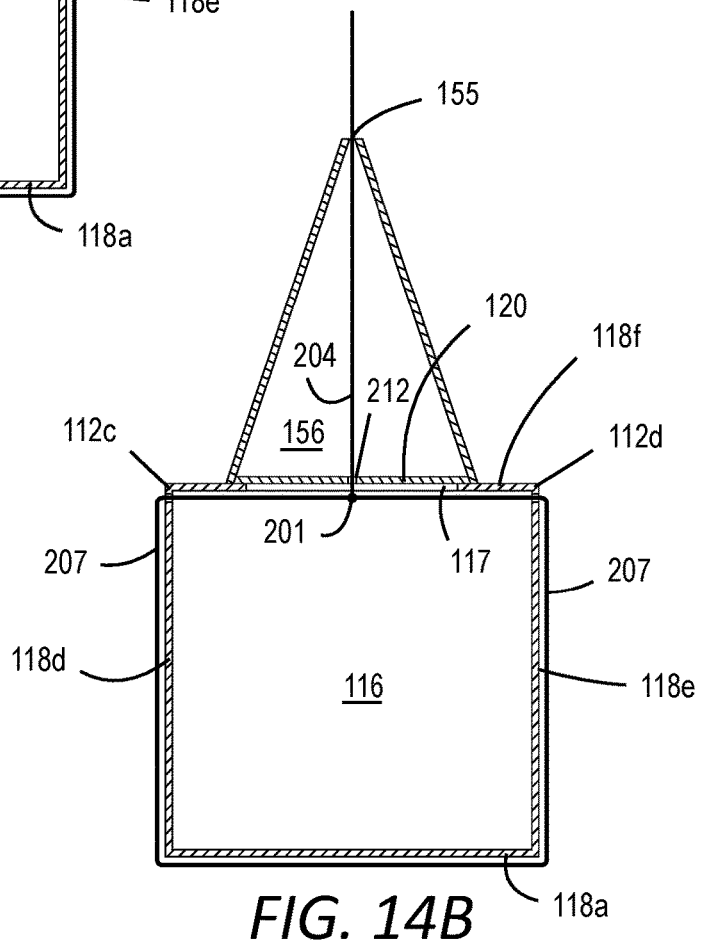
FIG. 14B is a cross-sectional front view of the central container and suspension system of the multi-compartment structure of FIG. 13B, taken along line B-B.

FIGS. 13A-14B illustrate another exemplary suspension system, in which the suspending element expends through a wall (e.g., a center of the wall) of the central container 110, and ultimately through the tip 155 of a fillable compartment 150 (e.g., as shown in FIGS. 10 and 11). In this exemplary system, the first and second supporting elements 206, 207 (e.g., strings, cords, wires, or the like) extend generally across the interior and/or exterior of the various walls 118*a*-118*f* and are connected to the suspending element 204 at a connection point 201 (e.g., a knot, fastener, or other means of attachment) located within the interior 116 of the container 110. The embodiments of FIGS. 13A and 14A, and the embodiment of FIGS. 13B and 14B are similar, except that the embodiment of FIGS. 13B and 14B includes an opening or hole 117 in the at least partially openable wall 118*f* As discussed above in connection with FIG. 4, the hole 117 may be covered with a base panel 120 sized and shaped to close the central container 110, or a sticker, or otherwise.

In both illustrated embodiments, wall 118*a* (hidden from view) defines the bottommost point of the central container 110. Supporting element 207 extends across walls 118*d*, 118*a*, and 118*e*, with terminal portions of the supporting element 207 extending under partially openable surface 118*f* to meet in the interior 116 of the central container 110. The suspending element 204 connects with supporting element 207 at the connection point 201, and exits the interior of the central container 110 through the suspension exit point 212 positioned adjacent to or at a center point of the partially openable wall 118*f*. FIGS. 14A and 14B further illustrate cross-sectional views of the fillable compartment 150 attached to wall 118*f*, through which the suspending element 204 extends.

Still viewing FIGS. 13A and 14A, the supporting elements 206, 207 are arranged perpendicularly to one another, and both ends of both supporting elements 206, 207 extend to the interior 116 of the central container 110 to meet at the connection point 201. The supporting elements 206, 207 may be installed on the central container 110 before the fillable compartments 150 have been partially affixed to each wall 118, or they may be installed after the multi-compartment structure 100 is fully assembled. In the embodiment shown in FIGS. 13-14, an entry point 213 is disposed along hinged edge 112*a*; however, it is contemplated that the central container 110 may be sealed and entry for the supporting elements 206, 207 into the interior 116 of the central container may be provided by a plurality of entry points (not shown) along each of the edges 112*a*, 112*b*, 112*c*, 112*d* adjacent to the partially openable wall 118*f*. According to an aspect, the partially openable wall 118*f* may be alternatively be opened to run one or more of the terminal ends of the supporting elements 206, 207 into the fillable central interior 116, and then subsequently sealed. Countless other possibilities are contemplated.

According to an aspect, the suspension system 200 may be formed of any material that has a tensile strength sufficient to support and suspend the multi-compartment structure 100 for the duration of its use, for example string, twine, or rope comprising polypropylene, polyester, nylon, cotton, or sisal fiber. According to an aspect, the suspension system 200 has a tensile strength sufficient to bear up to 45 pounds of weight. The suspension system 200 supports and suspends the multi-compartment structure 100 in a manner that allows for free rotation of multi-compartment structure 100 from the suspension point (e.g., a tree, beam, hook, etc.). The suspension system 200 securely engages the central compartment 110 so as to not interfere with the breaking and removal of the fillable compartments 150. In an aspect, the suspension system 200 is configured to permit removal of each of the plurality of fillable compartments 150 from the walls of the central container while supporting the central container. Due to the prolonged duration of use of the multi-compartment structure 100, the suspension system 200 is configured to withstand multiple hits while preventing the central container 110 from prematurely falling from a suspension point, such as a tree or a beam, before being broken open by the user.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A multi-compartment structure for storing a variety of novelty items to be released in a party game setting, the multi-compartment structure comprising:

a central container including a plurality of walls defining a fillable central interior, wherein at least one wall comprises an at least partially openable wall; and a fillable compartment at least partially affixed to each of the walls, the fillable compartment including a fillable compartment interior; and a suspension system, comprising at least one supporting element extending across the external surface of at least one of the walls to traverse a bottommost point of the central container; and a suspending element configured for suspending the multi-compartment structure from a suspension point, wherein the supporting element and suspending element are joined to one another.

2. The multi-compartment structure of claim 1, wherein the central container and the fillable compartment are each independently openable, fillable, and sealable.

3. The multi-compartment structure of claim 1, wherein the central container is substantially shaped as a cube.

4. The multi-compartment structure of claim 1, wherein the multi-compartment structure is formed from a material having a thickness of from about 0.8 mm and about 4.8 mm.

5. The multi-compartment structure of claim 1, further comprising:

a hinged edge connecting the partially openable wall to an adjacent wall, wherein the partially openable wall is configured for hingedly opening to provide access to the fillable central interior of the central container.

6. The multi-compartment structure of claim 1, wherein the multi-compartment structure includes six fillable compartments.

7. The multi-compartment structure of claim 1, further comprising an aperture formed in at least one of the central container and the fillable compartment.

8. The multi-compartment structure of claim 1, wherein the at least one supporting element extends along an x-z plane across the more than one wall of the central container.

9. The multi-compartment structure of claim 8, wherein the at least one supporting element is a first supporting element, and the at least one supporting element further comprises a second supporting element extending across the external surface of more than one wall of the central container along a y-z plane perpendicular to the first supporting element, wherein the first supporting element and second supporting element intersect on a bottom wall.

10. The multi-compartment structure of claim 9, the central container further comprising a suspension exit point, wherein the suspending element extends from the fillable central interior of the central container through the suspension exit point.

11. The multi-compartment structure of claim 10, wherein the suspension exit point is positioned along an edge adjoining two walls.

12. The multi-compartment structure of claim 10, wherein the first supporting element and second supporting element are joined to one another inside the fillable central interior of the central container adjacent the suspension exit point.

13. A multi-compartment structure for use as a party game, the multi-compartment structure comprising:

a central container including a plurality of exterior walls a plurality of fillable compartments joined to the central container; and a suspension system, comprising:

at least one supporting element extending across the external surface of at least one of the walls to traverse a bottommost point of the central container; and a suspending element configured for suspending the multi-compartment structure from a suspension point, wherein:

the central container and the plurality of fillable compartments are each independently configured for receiving novelty items, such that the walls of the central container separate the novelty items in the central container from the novelty items in the plurality of fillable compartments, the party game includes imparting a force to the multi-compartment structure to at least partially separate each of the plurality of fillable compartments from the central container and release the novelty items contained therein, and the suspension system is configured to permit removal of each of the plurality of fillable compartments from the walls of the central container while supporting the central container.

14. The multi-compartment structure of claim 13, wherein each of the plurality of fillable compartments includes a base edge configured for attachment to the wall of the central container.

15. The multi-compartment structure of claim 14, further comprising:

an attachment element extending from the base edge of each of the fillable structures, the attachment element comprising an adhesive tab configured for at least one of securement to an exterior surface of the wall or passage through a slot in the wall into the fillable central interior of the central container for securement to an interior surface of the wall.

16. The multi-compartment structure of claim 14, wherein each of the plurality of fillable structures is shaped as a cone including a tip and a face extending between the base edge and the tip.

17. A method of assembling a multi-compartment structure, comprising:

forming a central container having a plurality of walls, the plurality of walls including a partially openable wall;

forming a fillable compartment;

affixing a base edge of the fillable compartment to an exterior surface of a wall of the central container;

positioning at least one supporting element around the central container to traverse a bottommost point of the central container;

filling the multi-compartment structure; and sealing the multi-compartment structure.

18. The method of claim 17, wherein filling the multi-compartment structure comprises at least one of filling the central container and filling the fillable compartment.

19. The method of claim 17, wherein filling the central container further comprises:

hingedly opening the partially openable wall;

filling a fillable central interior defined by the plurality of walls; and sealing the partially openable wall.

* * * * *